US007722754B2

(12) United States Patent
Hatanaka et al.

(10) Patent No.: US 7,722,754 B2
(45) Date of Patent: May 25, 2010

(54) MICROSTRUCTURE AND METHOD OF MANUFACTURING THE SAME

(75) Inventors: Yusuke Hatanaka, Haibara-gun (JP); Tadabumi Tomita, Haibara-gun (JP); Yoshinori Hotta, Haibara-gun (JP); Akio Uesugi, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 253 days.

(21) Appl. No.: 11/808,502

(22) Filed: Jun. 11, 2007

(65) Prior Publication Data

US 2007/0289945 A1 Dec. 20, 2007

(30) Foreign Application Priority Data

Jun. 16, 2006 (JP) ..... 2006-167540

(51) Int. Cl.
*C25D 11/06* (2006.01)
*B32B 3/26* (2006.01)

(52) U.S. Cl. ..... 205/324; 205/172; 205/175; 205/221; 428/304.4

(58) Field of Classification Search ..... None
See application file for complete search history.

(56) References Cited

U.S. PATENT DOCUMENTS 4,066,816 A * 1/1978 Sheasby et al. ..... 428/336
2002/0145826 A1* 10/2002 Zangari et al. ..... 360/135
2005/0211566 A1 9/2005 Tomita et al.

FOREIGN PATENT DOCUMENTS

| | | | |
|---|---|---|---|
| JP | 2004-217961 | A | 8/2004 |
| JP | 2005-156695 | A | 6/2005 |
| JP | 2005-307341 | A | 11/2005 |
| JP | 2006-124827 | A | 5/2006 |

* cited by examiner

*Primary Examiner*—Ling Xu
(74) *Attorney, Agent, or Firm*—Sughrue Mion, PLLC

(57) ABSTRACT

A method of manufacturing a microstructure wherein an aluminum member having an aluminum substrate and a micropore-bearing anodized film present on a surface of the aluminum substrate is subjected at least to, in order, a pore-ordering treatment which involves performing one or more cycles of a step that includes a first film dissolution treatment for dissolving the anodized film until a barrier layer has a thickness of 3 to 50 nm, and an anodizing treatment which follows the first film dissolution treatment; and a second film dissolution treatment for dissolving the anodized film so that a ratio of a diameter of a micropore opening "a" to a micropore diameter at a height "a/2" from a micropore bottom "b" (a/b) is in a range of 0.9 to 1.1, whereby the microstructure having micropores formed on a surface thereof is obtained. The manufacturing method enables microstructures having an ordered array of pits to be obtained in a short period of time.

7 Claims, 3 Drawing Sheets

MICROSTRUCTURE AND METHOD OF MANUFACTURING THE SAME

The entire contents of all documents cited in this specification are incorporated herein by reference.

BACKGROUND OF THE INVENTION

The present invention relates to a microstructure and its manufacturing method.

In the technical field of metal and semiconductor thin films, wires and dots, it is known that the movement of free electrons becomes confined at sizes smaller than some characteristic length, as a result of which singular electrical, optical and chemical phenomena become observable. Such phenomena are called "quantum mechanical size effects" or simply "quantum size effects." Functional materials which employ such singular phenomena are under active research and development. Specifically, materials having structures smaller than several hundred nanometers in size, typically called microstructures or nanostructures, are the subject of current efforts in material development.

Methods for manufacturing such microstructures include processes in which a nanostructure is directly manufactured by semiconductor fabrication technology, including micropatterning technology such as photolithography, electron beam lithography, or x-ray lithography.

Of particular note is the considerable amount of research being conducted today on processes for manufacturing nanostructures having an ordered microstructure.

One method of forming an ordered structure in a self-regulating manner is illustrated by an anodized alumina film (anodized film) obtained by subjecting aluminum to anodizing treatment in an electrolytic solution. It is known that a plurality of micropores having diameters of about several nanometers to about several hundreds of nanometers are formed in a regular arrangement within the anodized film. It is also known that when a completely ordered arrangement is obtained by the self-pore-ordering treatment of this anodized film, hexagonal columnar cells will be theoretically formed, each cell having a base in the shape of a regular hexagon centered on a micropore, and that the lines connecting neighboring micropores will form equilateral triangles.

Known examples of applications for such anodized films having micropores include optical functional nanodevices, magnetic devices, luminescent supports and catalyst supports. For example, JP 2005-307341 A describes that an anodized film is applied to a Raman spectrometer by sealing pores with a metal and generating localized plasmon resonance.

JP 2005-156695 A describes that surface pores are subjected to a combination of anodizing treatment and pore widening treatment to produce an anodized porous alumina film in which pores have continuously changing diameters and are thus given tapered shapes.

A method is known in which pits serving as starting points for micropore formation in anodizing treatment are formed prior to anodizing treatment for forming such micropores. Formation of such pits facilitates controlling the micropore arrangement and variations in pore diameter within desired ranges.

A self-ordering method that makes use of the self-ordering nature in the anodized film is known as a general method for forming pits. This is a method which enhances the orderliness by using the regularly arranging nature of micropores in the anodized film and eliminating factors that may disturb an orderly arrangement.

As described in JP 2005-307341 A, the self-ordering method generally involves performing anodizing treatment, then immersion in a mixed aqueous solution of phosphoric acid and chromic (VI) acid, and thereafter performing anodizing treatment again.

SUMMARY OF THE INVENTION

However, the film removal step using a mixed aqueous solution of phosphoric acid and chromic (VI) acid has usually required an extended period of time (e.g., from several hours to well over ten hours) although the time required varies with the thickness of the anodized film.

It is therefore an object of the invention to provide a microstructure-manufacturing method that is capable of obtaining in a short period of time a microstructure having an ordered array of pits. Another object of the invention is to provide the microstructure obtained by the manufacturing method described above.

The inventors have made intensive studies to achieve the above objects and found that a structure having an ordered array of pits can be obtained in a short period of time by sequentially performing a first film dissolution treatment in which an anodized film is slightly dissolved; anodizing treatment; and a second film dissolution treatment in which the anodized film is dissolved, instead of the film removal step using a mixed aqueous solution of phosphoric acid and chromic (VI) acid. The invention has been completed on the basis of such finding.

Accordingly, the invention provides the following (i) to (v).

(i) A method of manufacturing a microstructure wherein an aluminum member having an aluminum substrate and a micropore-bearing anodized film present on a surface of the aluminum substrate is subjected at least to, in order, a pore-ordering treatment which involves performing one or more cycles of a step that includes a first film dissolution treatment for dissolving the anodized film until a barrier layer has a thickness of 3 to 50 nm, and an anodizing treatment which follows the first film dissolution treatment; and a second film dissolution treatment for dissolving the anodized film so that a ratio of a diameter of a micropore opening "a" to a micropore diameter at a height "a/2" from a micropore bottom "b" (a/b) is in a range of 0.9 to 1.1, whereby the microstructure having micropores formed on a surface thereof is obtained.

(ii) The manufacturing method according to (i) above, wherein the micropores at an interface between the anodized film and the aluminum substrate in the aluminum member has a degree of ordering as defined by formula (1):

$$\text{Degree of Ordering } (\%) = B/A \times 100 \quad (1)$$

(wherein A represents a total number of micropores in a measurement region; and B represents a number of specific micropores in the measurement region for which, when a circle is drawn so as to be centered on a center of gravity of a specific micropore and so as to be of a smallest radius that is internally tangent to an edge of another micropore, the circle includes centers of gravity of six micropores other than the specific micropore) of at least 10%.

(iii) The manufacturing method according to (i) or (ii) above, wherein two or more cycles of the step are performed in the pore-ordering treatment and a different voltage is used in the anodizing treatment of each of the two or more cycles of the step.

(iv) A microstructure obtained by the manufacturing method according to any one of (i) to (iii) above.

(v) The microstructure according to (iv) above, wherein a degree of ordering of micropores on its surface as defined by formula (1):

$$\text{Degree of Ordering (\%)} = B/A \times 100 \quad (1)$$

(wherein A represents a total number of micropores in a measurement region; and B represents a number of specific micropores in the measurement region for which, when a circle is drawn so as to be centered on a center of gravity of a specific micropore and so as to be of a smallest radius that is internally tangent to an edge of another micropore, the circle includes centers of gravity of six micropores other than the specific micropore) is at least 50%.

The manufacturing method of the invention enables microstructures having an ordered array of pits to be obtained in a short period of time.

DETAILED DESCRIPTION OF THE PREFERRED EMBODIMENTS

The invention is described more fully below.

The invention provides a method of manufacturing a microstructure wherein an aluminum member having an aluminum substrate and a micropore-bearing anodized film present on a surface of the aluminum substrate is subjected at least to, in order, a pore-ordering treatment which involves performing one or more cycles of a step that includes a first film dissolution treatment for dissolving the anodized film until a barrier layer has a thickness of 3 to 50 nm, and an anodizing treatment which follows the first film dissolution treatment; and a second film dissolution treatment for dissolving the anodized film so that the ratio of the diameter of a micropore opening "a" to the micropore diameter at the height "a/2" from the micropore bottom "b" (a/b) is in the range of 0.9 to 1.1, whereby the microstructure having micropores formed on a surface thereof is obtained.

<Aluminum Member>

The aluminum member used in the invention has an aluminum substrate and a micropore-bearing anodized film present on a surface of the aluminum substrate. Such an aluminum member may be obtained by performing anodizing treatment on at least one surface of the aluminum substrate.

FIGS. 1A to 1D are end views schematically showing an aluminum member and a microstructure for illustrating the inventive method of manufacturing microstructures.

Figure 1A:
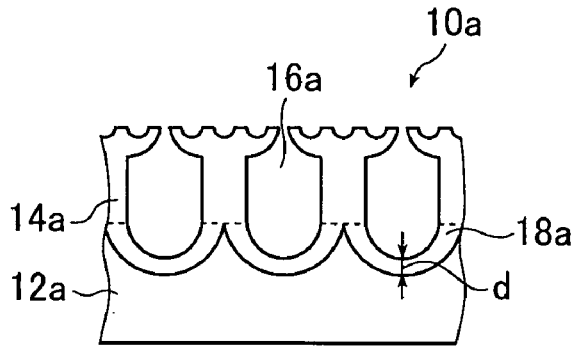
FIGS. 1A to 1D are end views schematically showing an aluminum member and a microstructure for illustrating the inventive method of manufacturing microstructures.

As shown in FIG. 1A, an aluminum member 10*a* includes an aluminum substrate 12*a* and an anodized film 14*a* which is present on a surface of the aluminum substrate 12*a* and has micropores 16*a*. The anodized film 14*a* has a barrier layer 18*a* on the side adjacent to the aluminum substrate 12*a*.

<Aluminum Substrate>

The aluminum substrate is not subject to any particular limitation. Illustrative examples include pure aluminum plate; alloy plates composed primarily of aluminum and containing trace amounts of other elements; substrates made of low-purity aluminum (e.g., recycled material) on which high-purity aluminum has been vapor-deposited; substrates such as silicon wafers, quartz or glass whose surface has been covered with high-purity aluminum by a process such as vapor deposition or sputtering; and resin substrates on which aluminum has been laminated.

Of the aluminum substrate, the surface on which an anodized film is provided by anodizing treatment has an aluminum purity of preferably at least 99.5 wt %, more preferably at least 99.9 wt % and even more preferably at least 99.99 wt %. At an aluminum purity within the above range, the pore arrangement will be sufficiently well-ordered.

There is no particular limitation on the shape of the aluminum substrate. The aluminum substrate may be, for example, in the form of a web or discrete sheets.

<Transport of Web with Rolls>

When the aluminum substrate is in the form of a web, the pore-ordering treatment including the first film dissolution treatment and the anodizing treatment as well as the second film dissolution treatment, which will be described later, are preferably performed on the aluminum web as it is transported.

From the viewpoint of stably transporting a large amount of aluminum web, transport rolls used for transporting the aluminum web each preferably has a radius of curvature of at least 50 mm, more preferably at least 70 mm and even more preferably at least 100 mm. At a radius of curvature within such range, the aluminum web is not strongly pressed against the transport rolls and is hence unlikely to tear.

In view of transport of a large amount of web, the aluminum web preferably has a width of at least 50 mm, more preferably at least 100 mm and even more preferably at least 150 mm. At a width within such range, the tension is unlikely to cause the aluminum web to tear.

In view of transport of a large amount of web, the transport rate is preferably 1 mm/min to 150 m/min, more preferably 10 mm/min to 100 m/min and even more preferably 50 mm/min to 50 m/min. Within such range, the transport rate is not so high that the aluminum web is not likely to tear, and is also not so low as to lower the productivity.

The aluminum web may be transported in a continuous or discontinuous manner.

It is preferable for the surface of the aluminum substrate to be subjected beforehand to degreasing and mirror-like finishing treatment.

If the microstructure obtained by the invention is to be used in applications that make use of its optical transparency, it is preferable that an aluminum substrate be subjected to heat treatment beforehand. Heat treatment will enlarge the region where the array of pores is highly ordered.

<Heat Treatment>

Heat treatment is preferably carried out at a temperature of from 200 to 350° C. for a period of about 30 seconds to about 2 minutes. The orderliness of the array of micropores formed in the subsequently described anodizing treatment is enhanced in this way.

Following heat treatment, it is preferable to rapidly cool the aluminum substrate. The method of cooling is exemplified by a method involving direct immersion of the aluminum substrate in water or the like.

<Degreasing>

Degreasing is carried out with a suitable substance such as an acid, alkali or organic solvent so as to dissolve and remove organic substances, including dust, grease and resins, adhering to the aluminum surface, and thereby prevent defects due to organic substances from arising in each of the subsequent treatments.

Known degreasers may be used in degreasing treatment. For example, degreasing may be carried out using any of various commercially available degreasers by the prescribed method.

Preferred methods include the following: a method in which an organic solvent such as an alcohol (e.g., methanol), a ketone, benzine or a volatile oil is brought into contact with the aluminum surface at ambient temperature (organic solvent method); a method in which a liquid containing a surfactant such as soap or a neutral detergent is brought into contact with the aluminum surface at a temperature of from ambient temperature to 80° C., after which the surface is rinsed with water (surfactant method); a method in which an aqueous sulfuric acid solution having a concentration of 10 to 200 g/L is brought into contact with the aluminum surface at a temperature of from ambient temperature to 70° C. for a period of 30 to 80 seconds, following which the surface is rinsed with water; a method in which an aqueous solution of sodium hydroxide having a concentration of 5 to 20 g/L is brought into contact with the aluminum surface at ambient temperature for about 30 seconds while electrolysis is carried out by passing a direct current through the aluminum surface as the cathode at a current density of 1 to 10 A/dm$^2$, following which the surface is brought into contact with an aqueous solution of nitric acid having a concentration of 100 to 500 g/L and thereby neutralized; a method in which any of various known anodizing electrolytic solutions is brought into contact with the aluminum surface at ambient temperature while electrolysis is carried out by passing a direct current at a current density of 1 to 10 A/dm$^2$ or an alternating current through the aluminum surface as the cathode; a method in which an aqueous alkali solution having a concentration of 10 to 200 g/L is brought into contact with the aluminum surface at 40 to 50° C. for 15 to 60 seconds, following which the surface is brought into contact with an aqueous nitric acid solution having a concentration of 100 to 500 g/L and thereby neutralized; a method in which an emulsion prepared by mixing a surfactant, water or the like into an oil such as gas oil or kerosene is brought into contact with the aluminum surface at a temperature of from ambient temperature to 50° C., following which the surface is rinsed with water (emulsion degreasing method); and a method in which a mixed solution of, for example, sodium carbonate, a phosphate and a surfactant is brought into contact with the aluminum surface at a temperature of from ambient temperature to 50° C. for 30 to 180 seconds, following which the surface is rinsed with water (phosphate method).

The method used for degreasing is preferably one which can remove grease from the aluminum surface but causes substantially no aluminum dissolution. Hence, an organic solvent method, surfactant method, emulsion degreasing method or phosphate method is preferred.

<Mirror-Like Finishing Treatment>

Mirror-like finishing treatment is carried out to eliminate surface asperities on the aluminum substrate and improve the uniformity and reproducibility of grain-forming treatment by a process such as electrodeposition. Examples of surface asperities on the aluminum member include rolling streaks formed during rolling when the aluminum member has been produced by a process including rolling.

In the practice of the invention, mirror-like finishing treatment is not subject to any particular limitation, and may be carried out using any suitable method known in the art. Examples of suitable methods include mechanical polishing, chemical polishing, and electrolytic polishing.

Illustrative examples of suitable mechanical polishing methods include polishing with various commercial abrasive cloths, and methods that combine the use of various commercial abrasives (e.g., diamond, alumina) with buffing. More specifically, a method which is carried out with an abrasive while changing over time the abrasive used from one having coarser particles to one having finer particles is appropriately illustrated. In such a case, the final abrasive used is preferably one having a grit size of 1500. In this way, a glossiness of at least 50% (in the case of rolled aluminum, at least 50% in both the rolling direction and the transverse direction) can be achieved.

Examples of chemical polishing methods include various methods mentioned in the 6$^{th}$ edition of Aluminum Handbook (Japan Aluminum Association, 2001), pp. 164-165.

Preferred examples include phosphoric acid/nitric acid method, Alupol I method, Alupol V method, Alcoa R5 method, $H_3PO_4$—$CH_3COOH$—Cu method and $H_3PO_4$—$HNO_3$—$CH_3COOH$ method. Of these, the phosphoric acid/nitric acid method, the $H_3PO_4$—$CH_3COOH$—Cu method and the $H_3PO_4$—$HNO_3$—$CH_3COOH$ method are especially preferred.

With chemical polishing, a glossiness of at least 70% (in the case of rolled aluminum, at least 70% in both the rolling direction and the transverse direction) can be achieved.

Examples of electrolytic polishing methods include various methods mentioned in the 6$^{th}$ edition of Aluminum Handbook (Japan Aluminum Association, 2001), pp. 164-165.

A preferred example is the method described in U.S. Pat. No. 2,708,655.

The method described in Jitsumu Hyomen Gijutsu (Practice of Surface Technology), Vol. 33, No. 3, pp. 32-38 (1986) is also preferred.

With electrolytic polishing, a glossiness of at least 70% (in the case of rolled aluminum, at least 70% in both the rolling direction and the transverse direction) can be achieved.

These methods may be suitably combined and used. In a preferred example, a method that uses an abrasive is carried out by changing over time the abrasive used from one having coarser particles to one having finer particles, following which electrolytic polishing is carried out.

Mirror-like finishing treatment enables a surface having, for example, a mean surface roughness $R_a$ of 0.1 μm or less and a glossiness of at least 50% to be obtained. The mean surface roughness $R_a$ is preferably 0.03 μm or less, and more preferably 0.02 μm or less. The glossiness is preferably at least 70%, and more preferably at least 80%.

The glossiness is the specular reflectance which can be determined in accordance with JIS Z8741-1997 (Method 3: 60° Specular Gloss) in a direction perpendicular to the rolling direction. Specifically, measurement is carried out using a variable-angle glossmeter (e.g., VG-1D, manufactured by Nippon Denshoku Industries Co., Ltd.) at an angle of incidence/reflection of 60° when the specular reflectance is 70% or less, and at an angle of incidence/reflection of 20° when the specular reflectance is more than 70%.

<Anodizing Treatment>

Any conventionally known method can be used for anodizing treatment. More specifically, a self-ordering method to be described below is preferably used.

The self-ordering method is a method which enhances the orderliness by using the regularly arranging nature of micropores in the anodized film and eliminating factors that may disturb an orderly arrangement. Specifically, an anodized film is formed on high-purity aluminum at a voltage appropriate for the type of electrolytic solution and at a low speed over an extended period of time (e.g., from several hours to well over ten hours).

In this method, because the pore diameter is dependent on the voltage, the desired pore diameter can be obtained to a certain degree by controlling the voltage.

The average flow rate in anodizing treatment is preferably 0.5 to 20.0 m/min, more preferably 1.0 to 15.0 m/min and even more preferably 2.0 to 10.0 m/min. Uniformity and high orderliness can be achieved by performing anodizing treatment at a flow rate within the above range.

The method of flowing the electrolytic solution under the condition described above is not subject to any particular limitation, and a method which uses a general stirring device such as a stirrer may be employed. Use of a stirrer capable of controlling the stirring speed in the digital display mode is preferable because the average flow rate can be controlled. An example of such stirring device includes a magnetic stirrer HS-50D (produced by As One Corporation).

Anodizing treatment may be carried out by, for example, a method that involves passing an electrical current through the aluminum substrate as the anode in a solution having an acid concentration of 1 to 10 wt %. Solutions that may be used in anodizing treatment are preferably acid solutions. It is preferable to use sulfuric acid, phosphoric acid, chromic acid, oxalic acid, sulfamic acid, benzenesulfonic acid and amidosulfonic acid, and more preferably sulfuric acid, phosphoric acid and oxalic acid. These acids may be used singly or in combination of two or more.

The conditions for anodizing treatment vary depending on the electrolytic solution used, and thus cannot be strictly specified. However, it is generally preferable for the electrolyte concentration to be 0.1 to 20 wt %, the temperature of the solution to be −10 to 30° C., the current density to be 0.01 to 20 A/dm$^2$, the voltage to be 3 to 300 V, and the period of electrolysis to be 0.5 to 30 hours. It is more preferable for the electrolyte concentration to be 0.5 to 15 wt %, the temperature of the solution to be −5 to 25° C., the current density to be 0.05 to 15 A/dm$^2$, the voltage to be 5 to 250 V, and the period of electrolysis to be 1 to 25 hours. It is particularly preferable for the electrolyte concentration to be 1 to 10 wt %, the temperature of the solution to be 0 to 20° C., the current density to be 0.1 to 10 A/dm$^2$, the voltage to be 10 to 200 V, and the period of electrolysis to be 2 to 20 hours.

The anodized film formed has a thickness of preferably 1 to 300 μm, more preferably 5 to 150 μm and even more preferably 10 to 100 μm.

The anodized film has a dense barrier layer on the side adjacent to the aluminum substrate.

The barrier layer of the anodized film that is present on the side adjacent to the aluminum substrate preferably has a thickness d (see FIG. 1A) of 5 to 100 nm and more preferably 10 to 70 nm.

The thickness of the barrier layer as used herein refers to a distance from the interface between the barrier layer and the aluminum substrate to the surface on the micropore side in the bottom of the micropore.

The thickness of the barrier layer can be measured, for example, by observing a fracture surface of the aluminum member with an FE-SEM (field emission scanning electron microscope).

Anodizing treatment is carried out for a period of preferably 0.5 minute to 16 hours, more preferably 1 minute to 12 hours, and even more preferably 2 minutes to 8 hours.

In addition to a method in which anodizing treatment is performed at a constant voltage, another method which involves changing the voltage continuously or intermittently may be used in anodizing treatment. In the latter case, it is preferable to gradually reduce the voltage. This method enables reduction of the resistance in the anodized film, thus achieving uniformity in the case where electrodeposition is to be performed later.

The average pore density is preferably from 50 to 1,500 pores/μm$^2$.

The area ratio occupied by the micropores is preferably from 20 to 50%. The area ratio occupied by the micropores is defined as the proportion of the sum of the areas of the individual micropore openings to the area of the aluminum surface.

At the interface between the anodized film and the aluminum substrate in the aluminum member, the micropores have a degree of ordering as defined by formula (1):

$$\text{Degree of Ordering (\%)} = B/A \times 100 \quad (1)$$

(wherein A represents the total number of micropores in a measurement region; and B represents the number of specific micropores in the measurement region for which, when a circle is drawn so as to be centered on the center of gravity of a specific micropore and so as to be of the smallest radius that is internally tangent to the edge of another micropore, the circle includes the centers of gravity of six micropores other than the specific micropore) of preferably at least 10%, more preferably at least 15% and even more preferably at least 20%. The degree of ordering within such range enables the treatment time required for pore-ordering treatment and therefore total treatment time to be shortened.

The method of calculating the degree of ordering of the micropores in the aluminum member is the same as that for the micropores in the microstructure to be described later except that the degree of ordering at the interface between the anodized film and the aluminum substrate is to be determined. This degree of ordering can be calculated after the bottoms of the micropores are bared by, for example, dissolving most of the anodized film in a mixed aqueous solution of phosphoric acid and chromic acid.

<Pore-Ordering Treatment>

Pore-ordering treatment is a treatment which involves performing one or more cycles of a step that includes a first film dissolution treatment for dissolving the anodized film until the thickness of the barrier layer is reduced to 3 to 50 nm and its subsequent anodizing treatment.

<First Film Dissolution Treatment>

The first film dissolution treatment is a treatment in which the anodized film in the aluminum member is dissolved until the thickness of the barrier layer is reduced to 3 to 50 nm.

The first film dissolution treatment dissolves part of the anodized film surface with irregular pore-arrangement and therefore enhances the orderliness of the array of micropores. On the other hand, part of the interior of each micropore in the anodized film is also dissolved, but presence of the barrier layer with the thickness as defined above enables the anodized film to keep having starting points for anodizing treatment to be described later.

Figure 1B:
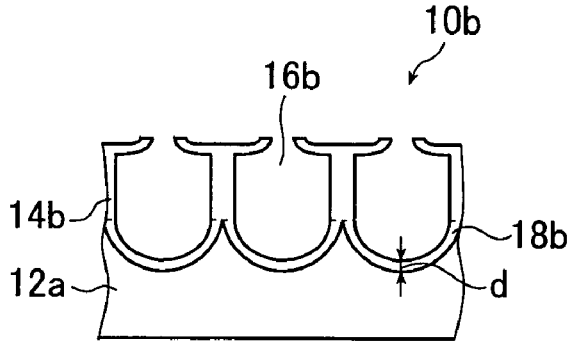

As shown in FIG. 1B, the first film dissolution treatment causes the surface of the anodized film 14*a* and the interiors of the micropores 16*a* (i.e., the barrier layer 18*a*) shown in FIG. 1A to dissolve to thereby obtain an aluminum member 10*b* having on the aluminum substrate 12*a* an anodized film 14*b* bearing micropores 16*b*. The barrier layer 18*a* remains at the bottoms of the micropores 16*b* as a barrier layer 18*b* with a thickness of 3 to 50 nm.

The first film dissolution treatment is carried out by bringing the aluminum member into contact with an aqueous acid solution or aqueous alkali solution. The contacting method is not particularly limited and is exemplified by immersion and spraying. Of these, immersion is preferable.

When the first film dissolution treatment is to be carried out with an aqueous acid solution, it is preferable to use an aqueous solution of an inorganic acid such as sulfuric acid, phosphoric acid, nitric acid or hydrochloric acid, or a mixture thereof. It is particularly preferable to use an aqueous solution containing no chromic acid owing to its high safety. It is desirable for the aqueous acid solution to have a concentration of 1 to 10 wt % and a temperature of 25 to 60° C.

When the first film dissolution treatment is to be carried out with an aqueous alkali solution, it is preferable to use an aqueous solution of at least one alkali selected from the group consisting of sodium hydroxide, potassium hydroxide and lithium hydroxide. It is preferable for the aqueous alkali solution to have a concentration of 0.1 to 5 wt % and a temperature of 20 to 35° C.

Specific examples of preferred solutions include a 40° C. aqueous solution containing 50 g/L of phosphoric acid, a 30° C. aqueous solution containing 0.5 g/L of sodium hydroxide, and a 30° C. aqueous solution containing 0.5 g/L of potassium hydroxide.

The aluminum member is immersed in the aqueous acid solution or aqueous alkali solution for a period of preferably 8 to 120 minutes, more preferably 10 to 90 minutes, and even more preferably 15 to 60 minutes.

The anodized film is dissolved in the first film dissolution treatment to such an amount that the barrier layer after the dissolution of the anodized film may have a thickness of 3 to 50 nm, preferably 5 to 40 nm and more preferably 10 to 30 nm. Within the above range, the anodized film surface with irregular pore-arrangement is dissolved to enhance the orderliness of the array of micropores, while at the same time the anodized film at the bottoms of the micropores remain undissolved to keep having starting points for anodizing treatment to be described later.

<Anodizing Treatment>

The first film dissolution treatment is followed by anodizing treatment, which causes the oxidation of the aluminum substrate to proceed to increase the thickness of the barrier layer of the anodized film that was partially dissolved in the first film dissolution treatment.

Figure 1C:
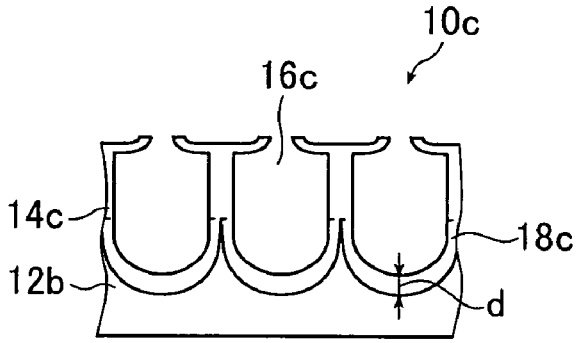

As shown in FIG. 1C, anodizing treatment causes the oxidation of the aluminum substrate 12*a* shown in FIG. 1B to proceed to obtain an aluminum member 10*c* that has on an aluminum substrate 12*b* deeper micropores 16*c* than the micropores 16*b* and a thicker barrier layer 18*c* of an anodized film 14*c* than the barrier layer 18*b* of the anodized film 14*b*.

Anodizing treatment may be carried out using a method known in the art, although it is preferably carried out under the same conditions as the above-described self-ordering method.

Suitable use can also be made of a method in which the current is repeatedly turned on and off in an intermittent manner while keeping the dc voltage constant, and a method in which the current is repeatedly turned on and off while intermittently changing the dc voltage. Because these methods enables formation of micropores in the anodized film, they are preferable for improving uniformity, particularly when supporting the catalyst is carried out by electrodeposition.

In the above method in which the voltage is intermittently changed, it is preferable to gradually reduce the voltage. It is possible in this way to lower the resistance in the anodized film, enabling uniformity to be achieved when electrodeposition is carried out later.

The thickness of the anodized film is preferably increased by 0.1 to 100 μm and more preferably 0.5 to 50 μm. Within the above range, the orderliness of the array of pores can be more enhanced.

The thickness of the barrier layer increased by anodizing treatment is preferably 1 to 90 nm and more preferably 5 to 60 nm.

In pore-ordering treatment, one or more cycles of the step that includes the first film dissolution treatment and its subsequent anodizing treatment as described above are performed. The larger the number of repetitions is, the more the orderliness of the array of pores is enhanced. In this regard, this step is repeatedly performed preferably twice or more, more preferably three times or more, and even more preferably four times or more.

When this step is repeatedly performed twice or more in pore-ordering treatment, the conditions of the first film dissolution treatment steps and the anodizing treatment steps in the respective cycles may be the same or different. In a preferred embodiment, different voltages may be used in two or more anodizing treatment steps from the viewpoint of enhancing the degree of ordering. In this case, it is more preferable to perform pore-ordering treatment under the conditions of gradually increased voltages from the viewpoint of enhancing the degree of ordering.

<Second Film Dissolution Treatment>

The second film dissolution treatment is a treatment in which the anodized film is dissolved so that the ratio of the diameter of a micropore opening "a" to the micropore diameter at the height "a/2" from the micropore bottom "b" (a/b) is in the range of 0.9 to 1.1. Pore-ordering treatment described above is followed by the second film dissolution treatment, which causes the surface of the anodized film to dissolve to obtain a microstructure having a highly ordered array of micropores.

Figure 1D:
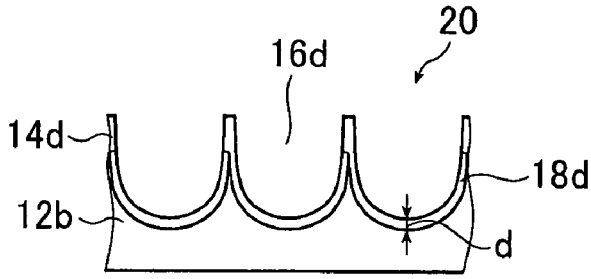

As shown in FIG. 1D, the second film dissolution treatment causes the surface of the anodized film 14*c* and the interiors of the micropores 16*c* shown in FIG. 1C to dissolve to thereby obtain a microstructure 20 having on the aluminum substrate 12*b* an anodized film 14*d* bearing micropores 16*d*.

The second film dissolution treatment may be basically performed on the same conditions as those in the first film dissolution treatment, so differences are only described below.

In the second film dissolution treatment, the anodized film is dissolved so that the ratio of the diameter of a micropore opening "a" to the micropore diameter at the height "a/2" from the micropore bottom "b" (a/b) is in the range of 0.9 to 1.1. When the ratio "a/b" falls within the above range, each of the micropores has a generally cylindrical shape, which is preferable from the viewpoint of increasing the specific surface area in the case where a microstructure having such micropores is used in such an application as a catalyst or a catalyst support.

The ratio "a/b" can be measured, for example, by observing a fracture surface of the aluminum member with the FE-SEM.

The amount of material dissolved out of the anodized film in the second film dissolution treatment is not particularly limited and is preferably 0.01 to 30 wt % and more preferably 0.1 to 15 wt %.

In the second film dissolution treatment, the aluminum member is immersed in the aqueous acid solution or aqueous alkali solution for a period of preferably 8 to 90 minutes, more preferably 10 to 60 minutes and even more preferably 15 to 45 minutes.

<Microstructure>

The manufacturing method of the invention yields the microstructure of the invention.

The average pore density of the microstructure of the invention is preferably from 50 to 1,500 pores/$\mu m^2$.

The area ratio occupied by the micropores in the microstructure of the invention is preferably from 20 to 50%.

In addition, the microstructure of the invention has preferably the micropores with a degree of ordering as defined by formula (1):

$$\text{Degree of Ordering (\%)} = B/A \times 100 \quad (1)$$

(wherein A represents the total number of micropores in a measurement region; and B represents the number of specific micropores in the measurement region for which, when a circle is drawn so as to be centered on the center of gravity of a specific micropore and so as to be of the smallest radius that is internally tangent to the edge of another micropore, the circle includes the centers of gravity of six micropores other than the specific micropore) of at least 50%.

Figure 2A:
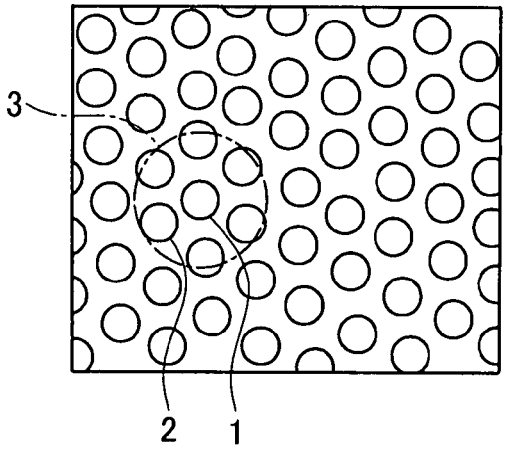
FIGS. 2A and 2B are views illustrating a method for computing the degree of ordering of pores.
Figure 2B:
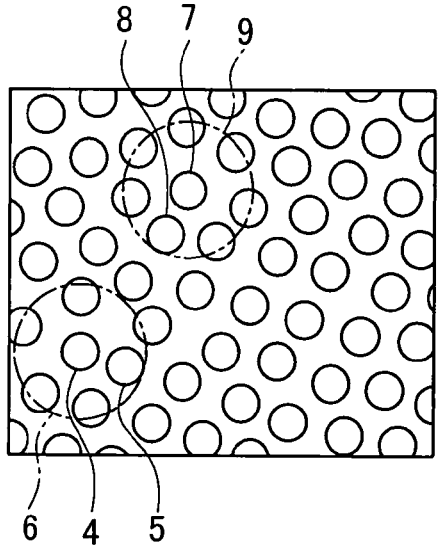

FIGS. 2A and 2B are views illustrating a method for computing the degree of ordering of pores. Formula (1) is explained more fully below in conjunction with FIGS. 2A and 2B.

With regard to a micropore 1 shown in FIG. 2A, when a circle 3 is drawn so as to be centered on the center of gravity of the micropore 1 and so as to be of the smallest radius that is internally tangent to the edge of another micropore (inscribed in a micropore 2), the interior of the circle 3 includes the centers of gravity of six micropores other than the micropore 1. Therefore, the micropore 1 is counted for B.

With regard to a micropore 4 shown in FIG. 2B, when a circle 6 is drawn so as to be centered on the center of gravity of the micropore 4 and so as to be of the smallest radius that is internally tangent to the edge of another micropore (inscribed in a micropore 5), the interior of the circle 6 includes the centers of gravity of five micropores other than the micropore 4. Therefore, the micropore 4 is not counted for B. With regard to a micropore 7 shown in FIG. 2B, when a circle 9 is drawn so as to be centered on the center of gravity of the micropore 7 and so as to be of the smallest radius that is internally tangent to the edge of another micropore (inscribed in a micropore 8), the interior of the circle 9 includes the centers of gravity of seven micropores other than the micropore 7. Therefore, the micropore 7 is not counted for B.

<Other Treatment>

Other treatments may be performed as needed.

For example, when the microstructure of the invention is to be used as a sample holder on which an aqueous solution will be deposited to form a film, hydrophilizing treatment may be performed to reduce the contact angle with water. Such hydrophilizing treatment may be performed by a method known in the art.

Alternatively, when the inventive microstructure is to be used as a sample holder for protein that will be denatured or decomposed with acid, neutralizing treatment may be performed to neutralize acids that are used in pore widening treatment and remain as residues on the aluminum surface. Such neutralizing treatment may be performed by a method known in the art.

In the microstructure of the invention, the aluminum substrate may be removed depending on the intended application.

The method of removing the aluminum substrate is not subject to any particular limitation, and it is preferable to use, for example, a method in which the aluminum substrate is immersed in a solvent in which alumina is hardly soluble or insoluble but aluminum is soluble.

Preferred solvents that may be used include halogen solvents (e.g., bromine and iodine); acidic solvents such as dilute sulfuric acid, phosphoric acid, oxalic acid, sulfamic acid, benzenesulfonic acid and amidosulfonic acid; and alkaline solvents such as sodium hydroxide, potassium hydroxide and calcium hydroxide. Bromine and iodine are particularly preferable.

The microstructure of the invention may support a catalyst in the micropores of the anodized film according to the intended application.

The catalyst is not subject to any particular limitation as long as the catalyst used has a catalytic function, and examples of the catalyst that may be used include $AlCl_3$, $AlBr_3$, $Al_2O_3$, $SiO_2$, $SiO_2$—$Al_2O_3$, silicon zeolite, $SiO_2$—NiO, active carbon, $PbO/Al_2O_3$, $LaCoO_3$, $H_3PO_4$, $H_4P_2O_7$, $Bi_2O_3$—$MoO_3$, $Sb_2O_5$, $SbO_5$—$Fe_2O_3$, $SnO_2$—$Sb_2O_5$, Cu, $CuO_2$—$Cr_2O_3$, Cu—$Cr_2O_3$—ZnO, $Cu/SiO_2$, $CuCl_2$, Ag/$\alpha$-$Al_2O_3$, Au, ZnO, ZnO—$Cr_2O_3$, $ZnCl_2$, ZnO—$Al_2O_3$—CaO, $TiO_2$, $TiCl_4.Al(C_2H_5)_3$, $Pt/TiO_2$, $V_2O_5$, $V_2O_5$—$P_2O_5$, $V_2O_5/TiO_2$, $Cr_2O_3$, $Cr_2O_3/Al_2O_3$, $MoO_{32}$, $MoO_3$—$SnO_2$, Co.Mo/$Al_2O_3$, Ni.Mo/$Al_2O_3$, $MoS_2$, Mo—Bi—O, $MoO_3$—$Fe_2O_3$, $H_3PMo_{12}O_{40}$, $WO_3$, $H_3PW_{12}O_{40}$, $MnO_2$, Fe—$K_2O$—$Al_2O_3$, $Fe_2O_3$—$Cr_2O_3$, $Fe_2O_3$—$Cr_2O_3$—$K_2O$, $Fe_2O_3$, Co, cobalt/active carbon, $Co_3O_4$, cobalt carbonyl complex, Ni, Raney nickel, nickel/support, modified nickel, Pt, $Pt/Al_2O_3$, Pt—Rh—Pd/support, Pd, $Pd/SiO_2$, $Pd/Al_2O_3$, $PdCl_2$—$CuCl_2$, Re, Re—$Pt/Al_2O_3$, $Re_2O_7/Al_2O_3$, Ru, $Ru/Al_2O_3$, Rh, and rhodium complex.

The method of supporting the catalyst is not particularly limited but any conventionally known technique may be used.

Examples of preferred techniques include electrodeposition, and a method which involves coating the aluminum member having the anodized film with a dispersion of catalyst particles, then drying. The catalyst is preferably in the form of single particles or agglomerates.

An electrodeposition method known in the art may be used. For example, in the case of gold electrodeposition, use may be made of a process in which the aluminum member is immersed in a 30° C. dispersion containing 1 g/L of $HAuCl_4$ and 7 g/L of $H_2SO_4$ and electrodeposition is carried out at a constant voltage of 11 V (regulated with an autotransformer such as SLIDAC) for 5 to 6 minutes.

An example of the electrodeposition method which employs copper, tin and nickel is described in detail in Gendai Kagaku (Contemporary Chemistry), pp. 51-54 (January 1997)). Use can be made of this method as well.

The dispersions employed in methods which use catalyst particles can be obtained by a conventionally known method. Illustrative examples include methods of preparing fine particles by low-vacuum vapor deposition and methods of preparing catalyst colloids by reducing an aqueous solution of a catalyst salt.

The colloidal catalyst particles have an average particle size of preferably 1 to 200 nm, more preferably 1 to 100 nm, and even more preferably 2 to 80 nm.

Preferred use can be made of water as the dispersion medium employed in the dispersion. Use can also be made of a mixed solvent composed of water and a solvent that is miscible with water, such as an alcohol, illustrative examples of which include ethyl alcohol, n-propyl alcohol, i-propyl alcohol, 1-butyl alcohol, 2-butyl alcohol, t-butyl alcohol, methyl cellosolve and butyl cellosolve.

No particular limitation is imposed on the technique used for coating the aluminum member with the dispersion of colloidal catalyst particles. Suitable examples of such techniques include bar coating, spin coating, spray coating, curtain coating, dip coating, air knife coating, blade coating and roll coating.

Preferred examples of dispersions that may be employed in methods which use colloidal catalyst particles include dispersions of colloidal gold particles and dispersions of colloidal silver particles.

Dispersions of colloidal gold particles that may be used include those described in JP 2001-89140 A and JP 11-80647 A. Commercial products may also be used.

Dispersions of colloidal silver particles preferably contain particles of silver-palladium alloys because these are not affected by the acids which leach out of the anodized film. The palladium content in such a case is preferably from 5 to 30 wt %.

Application of the dispersion is followed by cleaning, which may be appropriately performed using a solvent such as water. As a result of such cleaning, only the catalyst particles supported in the micropores remain in the anodized film whereas catalyst particles that have not been supported in the micropores are removed.

The amount of supported catalyst is preferably 10 to 1,000 $mg/m^2$, more preferably 50 to 800 $mg/m^2$ and even more preferably 100 to 500 $mg/m^2$.

The surface porosity after catalyst supporting treatment is preferably not more than 70%, more preferably not more than 50% and even more preferably not more than 30%. The surface porosity after catalyst supporting treatment is defined as the sum of the areas of the openings in micropores having no catalyst supported therein relative to the area of the aluminum surface.

Colloidal catalyst particles which may be used in the dispersion generally have a dispersion in the particle size distribution, expressed as the coefficient of variation, of about 10 to 20%. In the practice of the invention, by setting the dispersion in pore size within a specific range, colloidal particles with dispersed particle size distribution can be efficiently supported.

When the pore size is 50 nm or more, suitable use may be made of a method which employs colloidal catalyst particles. When the pore size is less than 50 nm, suitable use may be made of an electrodeposition process. Suitable use may also be made of a method which combines both approaches.

The microstructure of the invention has regularly arranged micropores, and can therefore be employed in various applications.

EXAMPLES

Examples are given below by way of illustration and should not be construed as limiting the invention.

1. Fabrication of Microstructure

Examples 1 to 6 and Comparative Examples 1 to 3

After having been subjected to mirror-like finishing treatment, substrate samples were subjected to the following treatments as shown in Tables 1-1 to 1-3: The substrate samples were subjected to preanodizing treatment, which was followed by pore-ordering treatment in Examples 1 to 6 and Comparative Examples 2 and 3 or film removal treatment and its subsequent anodizing treatment in Comparative Example 1; the second film dissolution treatment was then performed to yield microstructures. In Tables 1-1 to 1-3, a dash (-) indicates that the treatment in question was not carried out.

The substrate and the respective treatments are described in detail below.

(1) Substrate

The substrate used to manufacture the microstructures was a high purity aluminum substrate (produced by Sumitomo Light Metal Industries, Ltd; purity, 99.99 wt %; thickness, 0.4 mm). This substrate was cut and used so as to enable anodizing treatment to be carried out over an area of 10 cm square.

(2) Mirror-Like Finishing Treatment

The substrate was subjected to the following mirror-like finishing treatment.

<Mirror-Like Finishing Treatment>

In mirror-like finishing treatment, polishing with an abrasive cloth, buffing, then electrolytic polishing were carried out in this order. After buffing, the substrate was rinsed with water.

Polishing with an abrasive cloth was carried out using a polishing platen (Abramin, produced by Marumoto Struers K.K.) and commercial water-resistant abrasive cloths. This polishing operation was carried out while successively changing the grit size of the water-resistant abrasive cloths in the following order: #200, #500, #800, #1000 and #1500.

Buffing was carried out using slurry-type abrasives (FM No. 3 (average particle size, 1 μm) and FM No. 4 (average particle size, 0.3 μm), both made by Fujimi Incorporated).

Electrolytic polishing was carried out for 2 minutes in an electrolytic solution of the composition indicated below (temperature, 70° C.), using the substrate as the anode and a carbon electrode as the cathode, and at a constant current of 130 $mA/cm^2$. The power supply was a GP0110-30R unit manufactured by Takasago, Ltd.

<Electrolytic Solution Composition>

| | |
|---|---|
| 85 wt % Phosphoric acid (Wako Pure Chemical Industries, Ltd.) | 660 mL |
| Pure water | 160 mL |
| Sulfuric acid | 150 mL |
| Ethylene glycol | 30 mL |

(3) Preanodizing Treatment

Preanodizing treatment was performed under the conditions shown in Table 1-1 or 1-2 on the surface of each substrate which had been mirror-like finished.

More specifically, the substrate immersed in the electrolytic solution was subjected to self-ordering anodizing treatment according to such conditions as the type and concentration of the electrolytic solution, voltage, temperature, average flow rate and treatment time shown in Table 1-1 or 1-2, thereby forming an anodized film having a thickness of about 12 μm. The barrier layer of the anodized film had a thickness of about 50 nm.

In self-ordering anodizing treatment, use was made of NeoCool BD36 (Yamato Scientific Co., Ltd.) as the cooling system, Pairstirrer PS-100 (Tokyo Rikakikai Co., Ltd.) as the stirring and warming unit, and a GP0650-2R unit (Takasago, Ltd.) as the power supply. The average flow rate of the electrolytic solution was measured using the vortex flow monitor FLM22-10PCW (manufactured by As One Corporation).

The anodized film thickness was measured using the eddy current thickness gauge EDY-1000 (manufactured by Sanko Electronic Laboratory Co., Ltd.). The thickness of the barrier layer was measured by observing the fracture surface of the aluminum member with the FE-SEM.

The degree of ordering of micropores at the interface between the anodized film and the aluminum substrate in the aluminum member was also measured. More specifically, the aluminum member was immersed in an aqueous solution of chromic anhydride and phosphoric acid as defined in JIS H8688 (1998)-H8688 at 50° C. for 12 hours. Then, its surface was photographed with the FE-SEM (at a magnification of 20,000×) and the degree of micropore ordering as defined by formula (1) was measured with a field of view of 2 μm×2 μm. The degree of ordering was measured at 10 points and the average of the measurements obtained was calculated. The results are shown in Table 1-4.

In Tables 1-1 to 1-3, the sulfuric acid and oxalic acid used were all reagents available from Kanto Chemical Co., Inc.

(4) Film Removal Treatment

In Comparative Example 1, preanodizing treatment was followed by film removal treatment under the conditions shown in Table 1-2 to remove the anodized film. (For the sake of convenience, the conditions of film removal treatment are described in the column of "First film dissolution treatment −1".

More specifically, the aluminum member having the anodized film was immersed in the treatment solution of the type, concentration and temperature shown in Table 1-2 for the period shown in Table 1-2.

In Tables 1-1 to 1-3, the chromic anhydride and phosphoric acid used were both reagents available from Kanto Chemical Co., Inc. The treatment solution used in film removal treatment had the composition specified in JIS H8688 (1998)-H8688.

(5) Anodizing Treatment

In Comparative Example 1, film removal treatment was followed by anodizing treatment under the conditions shown in Table 1-2.

More specifically, the aluminum member having undergone film removal treatment was immersed in the electrolytic solution of the type and concentration shown in Table 1-2 to perform electrolysis according to such conditions as the voltage, temperature, average flow rate and treatment time shown in Table 1-2, thereby forming the anodized film with a thickness of 85 μm.

The anodized film thickness was measured by the same method as above.

(6) Pore-Ordering Treatment

In Examples 1 to 6 and Comparative Examples 2 and 3, pore-ordering treatment was performed which involved performing one or more cycles of a step that included a first film dissolution treatment for dissolving part of the anodized film having undergone preanodizing treatment and its subsequent anodizing treatment.

First, each aluminum member was immersed in the treatment solution of the type, concentration and temperature shown in any of Tables 1-1 to 1-3 for the period shown in any of Tables 1-1 to 1-3 to perform the first film dissolution treatment.

After the first film dissolution treatment was performed, the barrier layer thickness was measured by the same method as above. The results are shown in Table 1-4.

Then, each aluminum member was immersed in the electrolytic solution of the type and concentration shown in any of Tables 1-1 to 1-3 to perform electrolysis for anodizing treatment under such conditions as the voltage, temperature, average flow rate and treatment time shown in any of Tables 1-1 to 1-3.

Anodizing treatment enabled the barrier layer of the anodized film in each aluminum member to grow to a thickness of about 50 nm.

(7) Second Film Dissolution Treatment

The second film dissolution treatment was performed after pore-ordering treatment in Examples 1 to 6 and Comparative Examples 2 and 3, and after anodizing treatment in Comparative Example 1, respectively, to thereby obtain the microstructures.

More specifically, each aluminum member was immersed in the treatment solution of the type, concentration and temperature shown in Table 1-3 for the period shown in Table 1-3 to perform the second film dissolution treatment.

After the second film dissolution treatment was performed, the fracture surface of each aluminum member was observed with the FE-SEM to measure the ratio "a/b" of the diameter of a micropore opening "a" to the micropore diameter at the height "a/2" from the micropore bottom "b". The results are shown in Table 1-4.

Example 7

A substrate, which was an aluminum web, was subjected to mirror-like finishing treatment through electrolytic polishing, preanodizing treatment, pore-ordering treatment and second film dissolution treatment in this order to yield a microstructure.

The substrate and the respective treatments are described in detail below.

(1) Substrate

The substrate used to manufacture the microstructure was a high purity aluminum web (produced by Sumitomo Light Metal Industries, Ltd; purity, 99.99 wt %; thickness, 0.4 mm; width, 300 mm).

(2) Mirror-Like Finishing Treatment Through Electrolytic Polishing

The substrate was subjected to electrolytic polishing for mirror-like finishing treatment.

<Mirror-Like Finishing Treatment Through Electrolytic Polishing>

Figure 3:
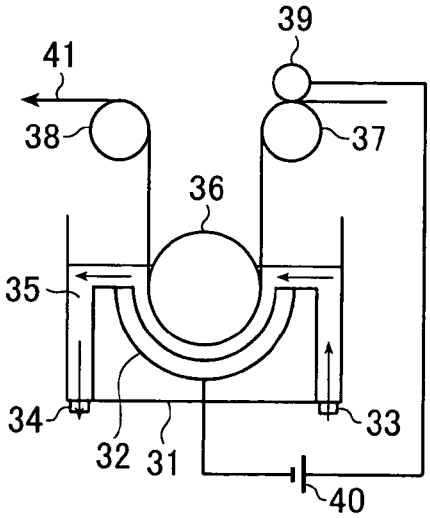
FIG. 3 schematically shows an electrolysis device used in the Examples.

In mirror-like finishing treatment, electrolytic polishing was performed using an electrolysis device shown in FIG. 3. FIG. 3 shows an electrolytic cell 31, a cathode electrode 32, an electrolytic solution inlet 33, an electrolytic solution outlet 34, an electrolytic solution 35, a drum roller 36, transport rollers 37, 38, a conductor roll 39, a power supply 40 and a substrate 41.

More specifically, electrolytic polishing was carried out for 2 minutes in an electrolytic solution of the composition indicated below (temperature, 70° C.), using the substrate as the anode and a carbon electrode as the cathode, under the conditions of a constant current of 130 mA/cm$^2$, an electrolytic solution average flow rate of 3 m/min and a substrate transport rate of 50 mm/min. The electrolytic solution flowed in the same direction as the direction of transport of the substrate (see FIG. 3).

<Electrolytic Solution Composition>

| | |
|---|---|
| 85 wt % Phosphoric acid (Wako Pure Chemical Industries, Ltd.) | 6.6 L |
| Pure water | 1.6 L |
| Sulfuric acid | 1.5 L |
| Ethylene glycol | 0.3 L |

(3) Preanodizing Treatment, Pore-Ordering Treatment and Second Film Dissolution Treatment On the substrate surface having undergone mirror-like finishing treatment through electrolytic polishing, a combination of anodizing treatment and film dissolution treatment was repeatedly performed five times as described below. Of the treatment steps having been performed, the first anodizing treatment step corresponds to preanodizing treatment, the fifth film dissolution treatment step to the second film dissolution treatment, and the four film dissolution treatment steps and four anodizing treatment steps which were performed between the first anodizing treatment step and the fifth film dissolution treatment step correspond to pore-ordering treatment.

Figure 4:
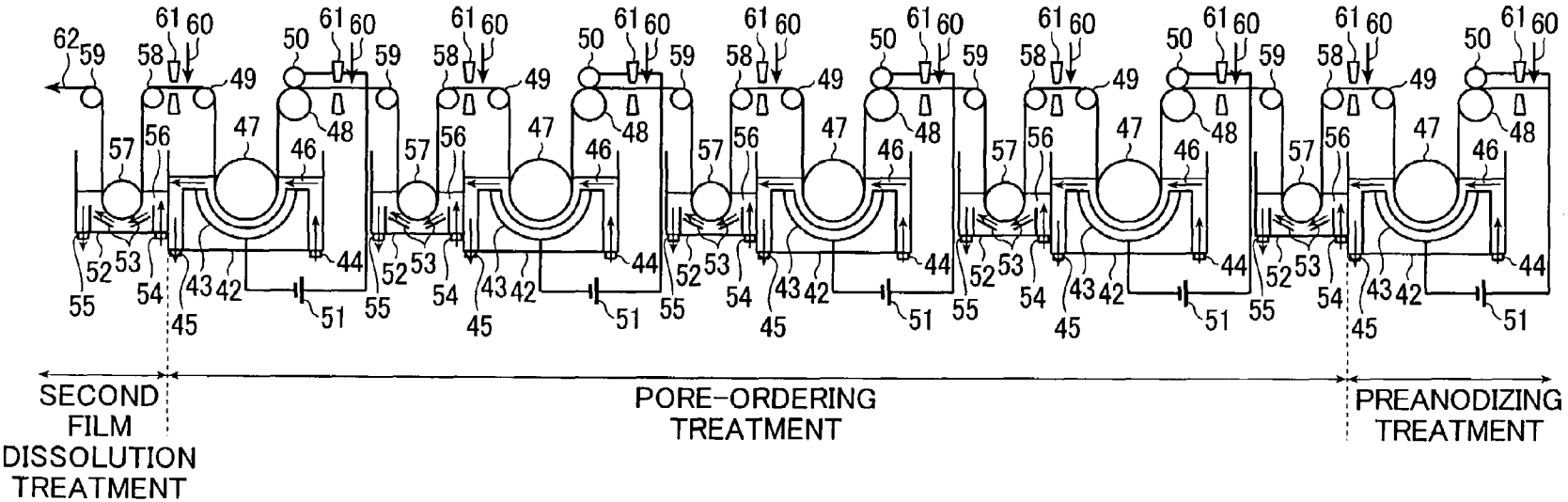
FIG. 4 schematically shows a treatment device that was used in the Examples and includes 5 units each composed of a combination of an electrolytic cell and a film dissolution treatment tank.

Anodizing treatment and film dissolution treatment were performed using a treatment device shown in FIG. 4 which includes 5 units each composed of a combination of an electrolytic cell and a film dissolution treatment tank. FIG. 4 shows electrolytic cells 42, cathode electrodes 43, electrolytic solution inlets 44, electrolytic solution outlets 45, an electrolytic solution 46, drum rollers 47, transport rollers 48, 49, conductor rolls 50, power supplies 51, film dissolution treatment tanks 52, guide plates 53 for a film dissolution treatment solution, film dissolution treatment solution inlets 54, film dissolution treatment solution outlets 55, the film dissolution treatment solution 56, drum rollers 57, transport rollers 58, 59, water rinsing sections 60, air drying sections 61 and a substrate 62.

<Anodizing Treatment>

More specifically, in the five anodizing treatment steps, the substrate was immersed in an electrolytic solution (an aqueous solution of 0.3 mol/L sulfuric acid (Wako Pure Chemical Industries, Ltd.); temperature, 15° C.) to perform electrolysis under the conditions of a voltage of 25V, an electrolytic solution average flow rate of 0.3 m/min, a substrate transport rate of 50 mm/min, and a treatment time of 60 minutes, whereby an anodized film was formed. The electrolytic solution flowed in the same direction as the direction of transport of the substrate (see FIG. 4).

After each anodizing treatment step was performed, the anodized film had a thickness of about 12 μm and the barrier layer of the anodized film had a thickness of about 50 nm. The thickness of the anodized film and that of the barrier layer were measured by the same method as used in Examples 1 to 6 and Comparative Examples 1 to 3.

The degree of ordering of the micropores at the interface between the anodized film and the aluminum substrate in the aluminum member having undergone the first anodizing treatment step was measured by the same method as used in Examples 1 to 6 and Comparative Examples 1 to 3. As a result, a degree of ordering of 45% was obtained.

<Film Dissolution Treatment>

The five film dissolution treatment steps were performed by immersing the anodized substrate in a treatment solution for film dissolution (aqueous solution of 0.6 mol/L phosphoric acid (Wako Pure Chemical Industries, Ltd.); temperature, 40° C.) under the condition of a treatment solution average flow rate of 2 m/min. The treatment solution for film dissolution flowed in the same direction as the direction of transport of the substrate (see FIG. 4).

The thickness of the barrier layer was measured by the same method as above after each of the first to fourth film dissolution treatment steps was performed. As a result, a barrier layer thickness of 10 nm was obtained after each of the first to fourth film dissolution treatment steps.

After the fifth film dissolution treatment step was performed, the ratio "a/b" of the diameter of a micropore opening "a" to the micropore diameter at the height "a/2" from the micropore bottom "b" was measured by the same method as used in Examples 1 to 6 and Comparative Examples 1 to 3. As a result, the ratio "a/b" was 0.98.

2. Surface Property of Microstructure

Surface images of the resulting microstructures were taken with the FE-SEM at a magnification of 20,000× and the degree of ordering of the micropores as defined by formula (1) was measured with a field of view of 2 μm×2 μm. The degree of ordering was measured at ten points and the average of the measurements was calculated. The results in Examples 1 to 6 and Comparative Examples 1 to 3 are shown in Table 1-4. The degree of ordering in Example 7 was 90%.

As is clear from Tables 1-1 to 1-4, the inventive method of manufacturing microstructures (as in Examples 1 to 7) does not require film removal treatment with a mixed aqueous solution of phosphoric acid and chromic acid and can therefore provide microstructures having highly ordered arrays of pores in a short period of time compared with the case where film removal treatment is performed (as in Comparative Example 1).

TABLE 1-1

| | | Example 1 | Example 2 | Example 3 | Example 4 | Example 5 | Example 6 |
|---|---|---|---|---|---|---|---|
| Preanodizing treatment | Electrolyte | 0.3 mol/L $H_2SO_4$ | 1.0 mol/L $H_2SO_4$ | 0.3 mol/L $H_2SO_4$ | 0.5 mol/L $C_2H_2O_4$ | 1.0 mol/L $C_2H_2O_4$ | 0.3 mol/L $H_2SO_4$ |
| | Voltage | 25 V | 25 V | 25 V | 40 V | 40 V | 15 V |
| | Temperature | 15° C. | 15° C. | 15° C. | 15° C. | 15° C. | 15° C. |
| | Average flow rate | 6.0 m/min | 6.0 m/min | 3.0 m/min | 3.0 m/min | 10.0 m/min | 10.0 m/min |

TABLE 1-1-continued

| | | | Example 1 | Example 2 | Example 3 | Example 4 | Example 5 | Example 6 |
|---|---|---|---|---|---|---|---|---|
| | | Treatment time | 1.0 h | 1.0 h | 1.0 h | 1.0 h | 2.0 h | 1.0 h |
| Pore-ordering treatment | First film dissolution treatment-1 | Treatment solution | 0.56 mol/L $H_3PO_4$ | 0.56 mol/L $H_3PO_4$ | 0.56 mol/L $H_3PO_4$ | 0.56 mol/L $H_3PO_4$ | 2.0 mol/L $H_2SO_4$ | 0.56 mol/L $H_3PO_4$ |
| | | Temperature | 40° C. | 40° C. | 40° C. | 40° C. | 30° C. | 40° C. |
| | | Treatment time | 20 min | 20 min | 20 min | 20 min | 40 min | 20 min |
| | Anodizing treatment-1 | Electrolyte | 0.3 mol/L $H_2SO_4$ | 1.0 mol/L $H_2SO_4$ | 0.3 mol/L $H_2SO_4$ | 0.5 mol/L $C_2H_2O_4$ | 1.0 mol/L $C_2H_2O_4$ | 0.3 mol/L $H_2SO_4$ |
| | | Voltage | 25 V | 25 V | 25 V | 40 V | 40 V | 25 V |
| | | Temperature | 15° C. | 15° C. | 15° C. | 15° C. | 15° C. | 15° C. |
| | | Average flow rate | 6.0 m/min | 6.0 m/min | 3.0 m/min | 3.0 m/min | 10.0 m/min | 10.0 m/min |
| | | Treatment time | 2.5 h | 1.0 h | 1.0 h | 1.0 h | 2.0 h | 1.0 h |
| | First film dissolution treatment-2 | Treatment solution | 0.56 mol/L $H_3PO_4$ | 0.56 mol/L $H_3PO_4$ | 0.56 mol/L $H_3PO_4$ | 0.56 mol/L $H_3PO_4$ | 2.0 mol/L $H_2SO_4$ | 0.56 mol/L $H_3PO_4$ |
| | | Temperature | 40° C. | 40° C. | 40° C. | 40° C. | 30° C. | 40° C. |
| | | Treatment time | 20 min | 20 min | 20 min | 20 min | 40 min | 20 min |
| | Anodizing treatment-2 | Electrolyte | 0.3 mol/L $H_2SO_4$ | 1.0 mol/L $H_2SO_4$ | 0.3 mol/L $H_2SO_4$ | 0.5 mol/L $C_2H_2O_4$ | 1.0 mol/L $C_2H_2O_4$ | 0.3 mol/L $H_2SO_4$ |
| | | Voltage | 25 V | 25 V | 25 V | 40 V | 40 V | 20 V |
| | | Temperature | 15° C. | 15° C. | 15° C. | 15° C. | 15° C. | 15° C. |
| | | Average flow rate | 6.0 m/min | 6.0 m/min | 3.0 m/min | 3.0 m/min | 10.0 m/min | 10.0 m/min |
| | | Treatment time | 2.5 h | 1.0 h | 1.0 h | 1.0 h | 2.0 h | 1.0 h |

TABLE 1-2

| | | Comparative Example 1 | Comparative Example 2 | Comparative Example 3 |
|---|---|---|---|---|
| Preanodizing treatment | | 0.3 mol/L $H_2SO_4$<br>25 V<br>15° C.<br>6.0 m/min<br>7.0 h | 0.3 mol/L $H_2SO_4$<br>25 V<br>15° C.<br>6.0 m/min<br>1.0 h | 0.3 mol/L $H_2SO_4$<br>25 V<br>15° C.<br>6.0 m/min<br>50 s |
| Pore-ordering treatment | First film dissolution treatment-1 | 0.2 mol/L/0.6 mol/L chromic anhydride/ $H_3PO_4$<br>50° C.<br>12.0 h | 0.56 mol/L $H_3PO_4$<br>60° C.<br>60 min | 0.22 mol/L $H_3PO_4$<br>30° C.<br>5 min |
| | Anodizing treatment-1 | 0.3 mol/L $H_2SO_4$<br>25 V<br>15° C.<br>6.0 m/min<br>2 min | 0.3 mol/L $H_2SO_4$<br>25 V<br>15° C.<br>6.0 m/min<br>2.5 h | 0.3 mol/L $H_2SO_4$<br>25 V<br>15° C.<br>6.0 m/min<br>50 s |
| | First film dissolution treatment-2 | — | 0.56 mol/L $H_3PO_4$<br>60° C.<br>60 min | 0.22 mol/L $H_3PO_4$<br>30° C.<br>5 min |
| | Anodizing treatment-2 | — | 0.3 mol/L $H_2SO_4$<br>25 V<br>15° C.<br>6.0 m/min<br>2.5 h | 0.3 mol/L $H_2SO_4$<br>25 V<br>15° C.<br>6.0 m/min<br>50 s |

TABLE 1-3

| | | | EX 1 | EX 2 | EX 3 | EX 4 | EX 5 | EX 6 | CE1 | CE2 | CE3 |
|---|---|---|---|---|---|---|---|---|---|---|---|
| Pore-ordering treatment (continued from Tables 1-1 and 1-2) | First film dissolution treatment-3 | Treatment solution | — | 0.56 mol/L $H_3PO_4$ | 0.56 mol/L $H_3PO_4$ | 0.56 mol/L $H_3PO_4$ | — | 0.56 mol/L $H_3PO_4$ | — | — | 0.22 mol/L $H_3PO_4$ |
| | | Temperature | | 40° C. | 40° C. | 40° C. | | 40° C. | | | 30° C. |
| | | Treatment time | | 20 min | 20 min | 20 min | | 20 min | | | 5 min |
| | Anodizing treatment-3 | Electrolyte | — | 1.0 mol/L $H_2SO_4$ | 0.3 mol/L $H_2SO_4$ | 0.5 mol/L $C_2H_2O_4$ | — | 0.3 mol/L $H_2SO_4$ | — | — | 0.3 M $H_2SO_4$ |
| | | Voltage | | 25 V | 25 V | 40 V | | 23 V | | | 25 V |
| | | Temperature | | 15° C. | 15° C. | 15° C. | | 15° C. | | | 15° C. |
| | | Average | | 6.0 m/min | 3.0 m/min | 3.0 m/min | | 6.0 m/min | | | 6.0 m/min |

TABLE 1-3-continued

| | | EX 1 | EX 2 | EX 3 | EX 4 | EX 5 | EX 6 | CE1 | CE2 | CE3 |
|---|---|---|---|---|---|---|---|---|---|---|
| | flow rate | | | | | | | | | |
| | Treatment time | | 1.0 h | 1.0 h | 1.0 h | | 1.0 h | | | 50 sec |
| First film dissolution treatment-4 | Treatment solution | — | — | 0.56 mol/L $H_3PO_4$ | 0.56 mol/L $H_3PO_4$ | — | 0.56 mol/L $H_3PO_4$ | — | — | 0.22 mol/L $H_3PO_4$ |
| | Temperature | | | 40° C. | 40° C. | | 40° C. | | | 30° C. |
| | Treatment time | | | 20 min | 20 min | | 20 min | | | 5 min |
| Anodizing treatment-4 | Electrolyte | — | — | 0.3 mol/L $H_2SO_4$ | 0.5 mol/L $C_2H_2O_4$ | — | 0.3 mol/L $H_2SO_4$ | — | — | 0.3 mol/L $H_2SO_4$ |
| | Voltage | | | 25 V | 40 V | | 25 V | | | 25 V |
| | Temperature | | | 15° C. | 15° C. | | 15° C. | | | 15° C. |
| | Average flow rate | | | 3.0 m/min | 6.0 m/min | | 3.0 m/min | | | 6.0 m/min |
| | Treatment time | | | 1.0 h | 1.0 h | | 1.0 h | | | 50 sec |
| Second film dissolution treatment | Treatment solution | 0.56 mol/L $H_3PO_4$ | 0.56 mol/L $H_3PO_4$ | 0.56 mol/L $H_3PO_4$ | 0.56 mol/L $H_3PO_4$ | 2.0 mol/L $H_2SO_4$ | 0.7 mol/L/ 0.5 mol/L $H_3PO_4/HNO_{03}$ | 0.56 mol/L $H_3PO_4$ | 0.56 mol/L $H_3PO_4$ | 0.22 mol/L $H_3PO_4$ |
| | Temperature | 40° C. | 40° C. | 40° C. | 40° C. | 30° C. | 40° C. | 30° C. | 60° C. | 30° C. |
| | Treatment time | 20 min | 20 min | 20 min | 20 min | 40 min | 20 min | 15 min | 60 min | 5 min |

TABLE 1-4

| | | | EX 1 | EX 2 | EX 3 | EX 4 | EX 5 | EX 6 | CE1 | CE2 | CE3 |
|---|---|---|---|---|---|---|---|---|---|---|---|
| Evaluation | Degree of ordering after preanodizing treatment (%) | | 55 | 75 | 45 | 50 | 75 | 35 | 90 | 55 | 5 |
| | Thickness of treated barrier layer (nm) | First film dissolution treatment-1 | 11 | 9 | 10 | 11 | 5 | 11 | 0 | 1 | 55 |
| | | First film dissolution treatment-2 | 10 | 10 | 10 | 10 | 4 | 10 | — | 2 | 52 |
| | | First film dissolution treatment-3 | — | 9 | 10 | 10 | — | 10 | — | — | 53 |
| | | First film dissolution treatment-4 | — | — | 10 | 10 | — | 11 | — | — | 55 |
| | a/b after second film dissolution treatment | | 1.02 | 1.00 | 0.98 | 1.05 | 1.00 | 0.94 | 1.01 | 1.00 | 0.50 |
| | Degree of ordering after second film dissolution treatment | | 90 | 90 | 90 | 90 | 90 | 90 | 90 | 35 | 70 |
| | Total treatment time (min) | | 420 | 320 | 400 | 400 | 480 | 400 | 1157 | 420 | 29 |

What is claimed is:

1. A method of manufacturing a microstructure wherein an aluminum member having an aluminum substrate and a micropore-bearing anodized film present on a surface of the aluminum substrate is subjected at least to, in order, a pore-ordering treatment which involves performing one or more cycles of a step that includes a first film dissolution treatment for dissolving the anodized film until a barrier layer has a thickness of 3 to 50 nm, and an anodizing treatment which follows the first film dissolution treatment; and a second film dissolution treatment for dissolving the anodized film so that a ratio of a diameter of a micropore opening "a" to a micropore diameter at a height "a/2" from a micropore bottom "b" (a/b) is in a range of 0.9 to 1.1, whereby the microstructure having micropores formed on a surface thereof is obtained, wherein the first film dissolution treatment is carried out by bringing the aluminum member into contact, by immersion, with one of: an aqueous acid solution containing no chromic acid and an aqueous alkali solution wherein the first dissolution treatment is performed without passing an electrical current.

2. A method of manufacturing a microstructure according to claim 1, wherein said aqueous acid solution includes an inorganic acid selected from the group consisting of sulfuric acid, phosphoric acid, nitric acid, hydrochloric acid, and a mixture thereof.

3. A method of manufacturing a microstructure according to claim 1, wherein said aqueous alkali solution includes at least one alkali selected from the group consisting of sodium hydroxide, potassium hydroxide and lithium hydroxide.

4. A method of manufacturing a microstructure according to claim 1, wherein said aluminum member is immersed in the aqueous acid solution or aqueous alkali solution for a period of 8 to 120 minutes.

5. A method of manufacturing a microstructure according to claim 1, wherein said aluminum member is immersed in the aqueous acid solution or aqueous alkali solution for a period of 10 to 90 minutes.

6. A method of manufacturing a microstructure according to claim 1, wherein said aluminum member is immersed in the aqueous acid solution or aqueous alkali solution for a period of 15 to 60 minutes.

7. A method of manufacturing a microstructure according to claim 1, wherein said aqueous acid solution or aqueous alkali solution used in said first film dissolution treatment is different from an electrolytic solution used in the anodizing treatment.

* * * * *